US006390828B1

(12) United States Patent
Yamaguchi et al.

(10) Patent No.: US 6,390,828 B1
(45) Date of Patent: May 21, 2002

(54) ELECTRICAL CONNECTOR ASSEMBLY PROVIDING FLOATING MOVEMENT BETWEEN CONNECTORS

(75) Inventors: Shigetoshi Yamaguchi; Tomisaburo Yamaguchi; Tatsuo Yasui, all of Kanagawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/632,835

(22) Filed: Aug. 4, 2000

(Under 37 CFR 1.47)

(30) Foreign Application Priority Data

Aug. 25, 1999 (JP) ..... 11-238383

(51) Int. Cl.[7] ..... H01R 9/09
(52) U.S. Cl. ..... 439/74; 439/64; 439/247
(58) Field of Search ..... 439/74, 246, 247, 439/248, 83, 660, 295, 64, 692, 693, 695, 697, 668, 515

(56) References Cited

U.S. PATENT DOCUMENTS 4,241,968 A 12/1980 Fukanaga ..... 339/64
5,569,053 A * 10/1996 Nelson et al. ..... 439/668
5,626,482 A 5/1997 Chan et al. ..... 439/74
5,704,812 A * 1/1998 Moji ..... 439/668
5,709,573 A * 1/1998 McClure ..... 439/857
5,830,018 A * 11/1998 Simmel ..... 439/660
5,879,177 A 3/1999 Honma ..... 439/246
5,980,290 A 11/1999 Meynier et al. ..... 439/246
6,019,613 A * 2/2000 Kataoka et al. ..... 439/83
6,155,858 A * 12/2000 Ozawa et al. ..... 439/248

* cited by examiner

*Primary Examiner*—P. Austin Bradley
*Assistant Examiner*—Alexander Gilman
(74) *Attorney, Agent, or Firm*—Stephen Z. Weiss

(57) ABSTRACT

An electrical connector assembly includes a receptacle connector having a dielectric housing with a mating receptacle portion and at least one conductive receptacle terminal mounted on the housing. The receptacle terminal has contact portions spaced apart generally at opposite sides of the receptacle portion. A plug connector includes a dielectric housing having a mating plug portion insertable into the receptacle portion of the receptacle connector in a mating direction. The plug portion is smaller than the receptacle portion in a direction transverse to the mating direction to provide a range of floating movement between the connectors. At least one conductive plug terminal is mounted on the housing of the plug connector and has resilient contact portions maintained in constant engagement with the spaced apart contact portions of the receptacle terminal throughout the entire range of the floating movement.

14 Claims, 7 Drawing Sheets

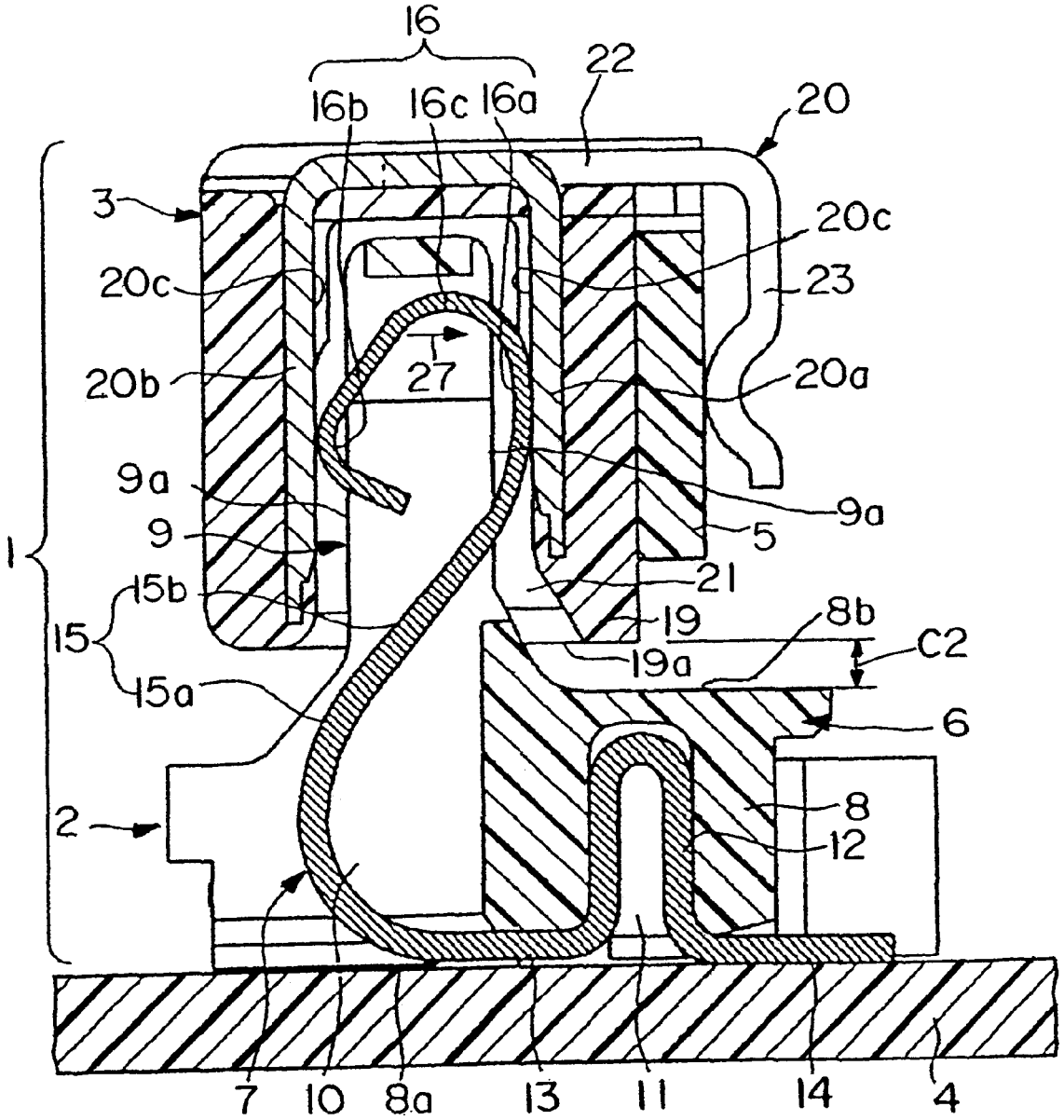
FIG.1
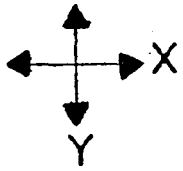

ELECTRICAL CONNECTOR ASSEMBLY PROVIDING FLOATING MOVEMENT BETWEEN CONNECTORS

FIELD OF THE INVENTION

This invention generally relates to the art of electrical connectors and, particularly, to an electrical connector assembly which provides for floating movement between a pair of mating connectors, such as connectors which are mounted to printed circuit boards or other substrates.

BACKGROUND OF THE INVENTION

There are a wide variety of electrical connector assemblies which include male and female or plug and receptacle connectors which are designed to be mated in confronting relation. The connectors are movably mated together and, when mated, the connectors are rigidly coupled and cannot move relative to each other. Therefore, any vibrations or extraneous impacts applied to one of the connectors is transmitted to the other connector.

There are various applications wherein rigidly coupled connectors are undesirable and create problems. In other words, it is highly undesirable for vibrations or impacts to be transmitted from one connector to the mated connector. This is particularly true when the connectors are mounted to various other electronic components such as circuit boards or other substrates.

For instance, in a portable telephone assembly, the telephone may be coupled to an associated battery through a pair of mating connectors, and the telephone and battery, in turn, may be mounted to a pair of circuit boards or substrates. If the telephone is inadvertently dropped and strikes the floor or ground, the impact may cause a malfunction or damage to electronic components mounted on the circuit boards on which the mating connectors are fixed. Therefore, it is desirable to provide some form of relative floating movement between the mating connectors, and this has become increasingly difficult with the increase in miniaturization or down-sizing of such electronic devices. One of the problems with mating connectors which are provided with relative floating movement is that, as the connector housings move relative to each other, the terminals of the respective connectors tend to disengage, particularly under severe conditions of vibration or collision shocks. The present invention is directed to solving these problems in a new construction of a pair of mating connectors having floating movement therebetween.

SUMMARY OF THE INVENTION

An object, therefore, of the invention is to provide a new and improved electrical connector assembly which provides for floating movement between a pair of mated connectors.

In the exemplary embodiment of the invention, the assembly is shown as a board-to-board electrical connector assembly, but the invention is not limited to such applications. A receptacle connector is shown mounted on a first circuit board and includes a dielectric housing having a mating receptacle portion. At least one conductive receptacle terminal is mounted on the housing and has contact portions spaced apart generally at opposite sides of the receptacle portion. A plug connector is shown mounted on a second circuit board and includes a dielectric housing having a mating plug portion insertable into the receptacle portion of the receptacle connector in a mating direction. The plug portion is smaller than the receptacle portion in a direction transverse to the mating direction to provide a range of floating movement between the connectors and, thereby, between the circuit boards transversely of the mating direction. At least one conductive plug terminal is mounted on the housing of the plug connector and includes resilient contact portions maintained in constant engagement with the spaced apart contact portions of the receptacle terminal throughout the entire range of the floating movement.

As disclosed herein, the resilient contact portions of the plug terminal are joined by a curved portion to provide resiliency for the contact portions. The curved portion and the resilient contact portions are at an end of a flexible contact beam of the plug terminal. The contact beam extends generally in the mating direction. The contact beam extends at an angle to the mating direction such that a force vector from the contact beam against the receptacle terminal opposite the mating direction automatically causes the receptacle portion of the receptacle connector to be spaced from an abutment wall of the plug connector to provide floating movement in a direction generally parallel to the mating direction.

According to an aspect of the invention, the resilient contact portions of the plug terminal, in an unstressed condition, are spaced apart wider than the spacing between the contact portions of the receptacle terminal. The resilient contact portions are spaced apart a sufficient distance to maintain constant engagement with the contact portions of the receptacle terminal throughout the entire range of the floating movement.

According to another aspect of the invention, the resilient contact portions of the plug terminal resiliently engage the contact portions of the receptacle terminal in an "X" direction transversely to the mating direction. The contact portions of the receptacle terminals have widths in a "Y" direction transverse to the "X" direction and transverse to the mating direction to maintain constant engagement when the connectors float in the "Y" direction.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is an enlarged vertical section through the connector assembly of the invention;

DETAILED DESCRIPTION OF THE PREFERRED EMBODIMENT

Figure 2:
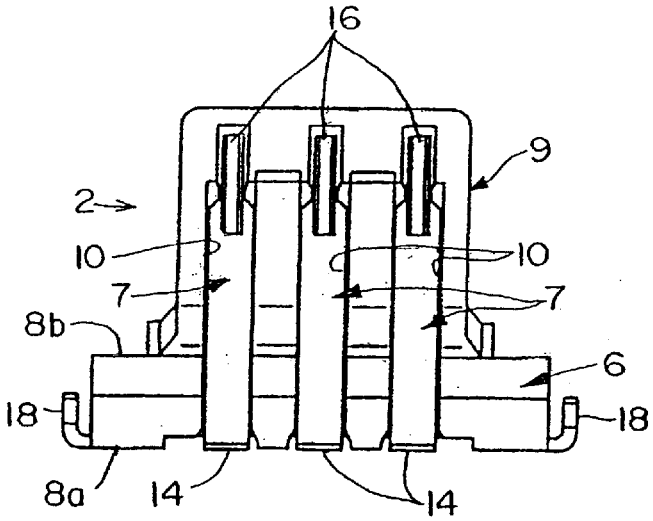
FIG. 2 is a front elevational view of the plug connector.
Figure 3:
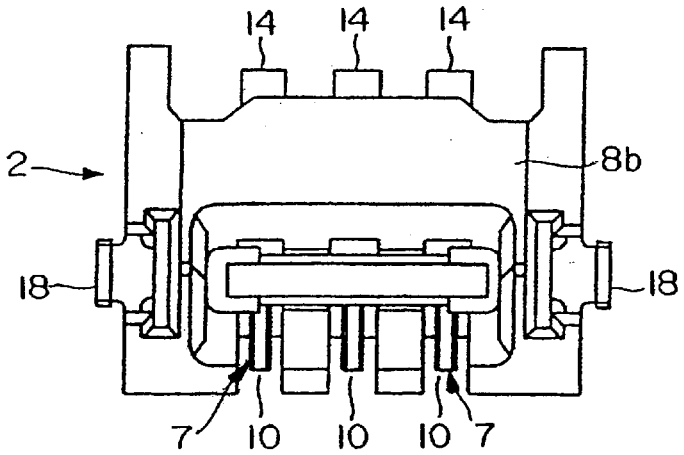
FIG. 3 is a top plan view of the plug connector.

Referring to the drawings in greater detail, FIG. 1 shows a board-to-board electrical connector assembly 1 which includes a plug connector, generally designated 2, and a receptacle connector, generally designated 3. The plug connector is adapted for mounting on a first circuit board 4 and is shown in greater detail in FIGS. 2–5. The receptacle connector is adapted for mounting on a second printed circuit board 5 and is shown in greater detail in FIGS. 6–12. The circuit boards are disposed in two planes perpendicular to each other, with the connectors making required electrical connections therebetween.

Referring to FIGS. 2–5 in conjunction with FIG. 1, plug connector 2 includes a dielectric housing, generally designated 6, mounting three plug terminals, generally designated 7. The housing may be a one-piece structure unitarily molded of dielectric material such as plastic or the like. The housing includes a terminal retaining portion 8 and a mating plug portion 9. The plug portion and part of the retaining portion include terminal-receiving slots 10, and the retaining portion has terminal mounting recesses 11 which open at a bottom face 8*a* of the housing. Terminal retaining portion 8 defines a top abutment wall 8*b*. Plug portion 9 has opposite side walls 9*a*.

Each terminal 7 of plug connector 2 includes an inverted U-shaped engagement portion 12 which is inserted into a respective one of the bottom-opening recesses 11 in housing 6 by a press-fit to retain the terminal on the housing. Each terminal includes a base portion 13 and a solder tail 14 which extend in opposite directions from the distal ends of the legs which define U-shaped engagement portion 12. The solder tails of the terminals arc connected, as by soldering, to appropriate circuit traces on circuit board 4. Each terminal includes a cantilevered spring beam 15 which extends upwardly and obliquely from base 13 into the respective terminal slot 10 in plug portion 9. A contact beam 16 extends obliquely from a distal end of spring beam 15 back over the spring beam. Contact beam 16 defines a pair of spaced apart resilient contact portions 16*a* and 16*b* joined by a curved portion 16*c*. Spring beam 15 includes a somewhat curved portion 15*a* leading to a more straight portion 15*b* which leads to contact beam 16 and contact portions 16*a* and 16*b*.

Figure 4:
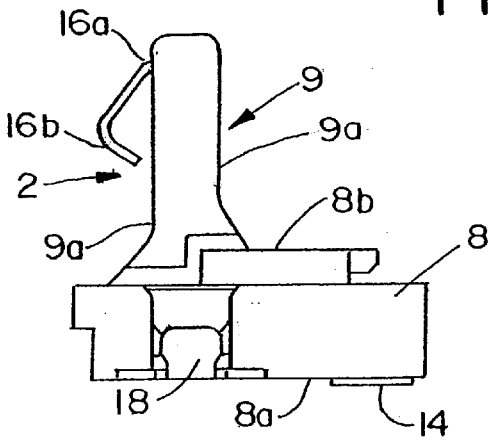
FIG. 4 is a side elevational view of the plug connector.

A pair of "fitting nails" 18 are fixed to housing 6 of plug connector 2 generally flush with solder tails 14 of plug terminals 7 as seen best in FIG. 4. These fitting nails are fabricated of metal material and are soldered to appropriate mounting pads on circuit board 4 when solder tails 14 are soldered to circuit traces on the board, to assist in fixing the plug connector to the board.

Figure 5:
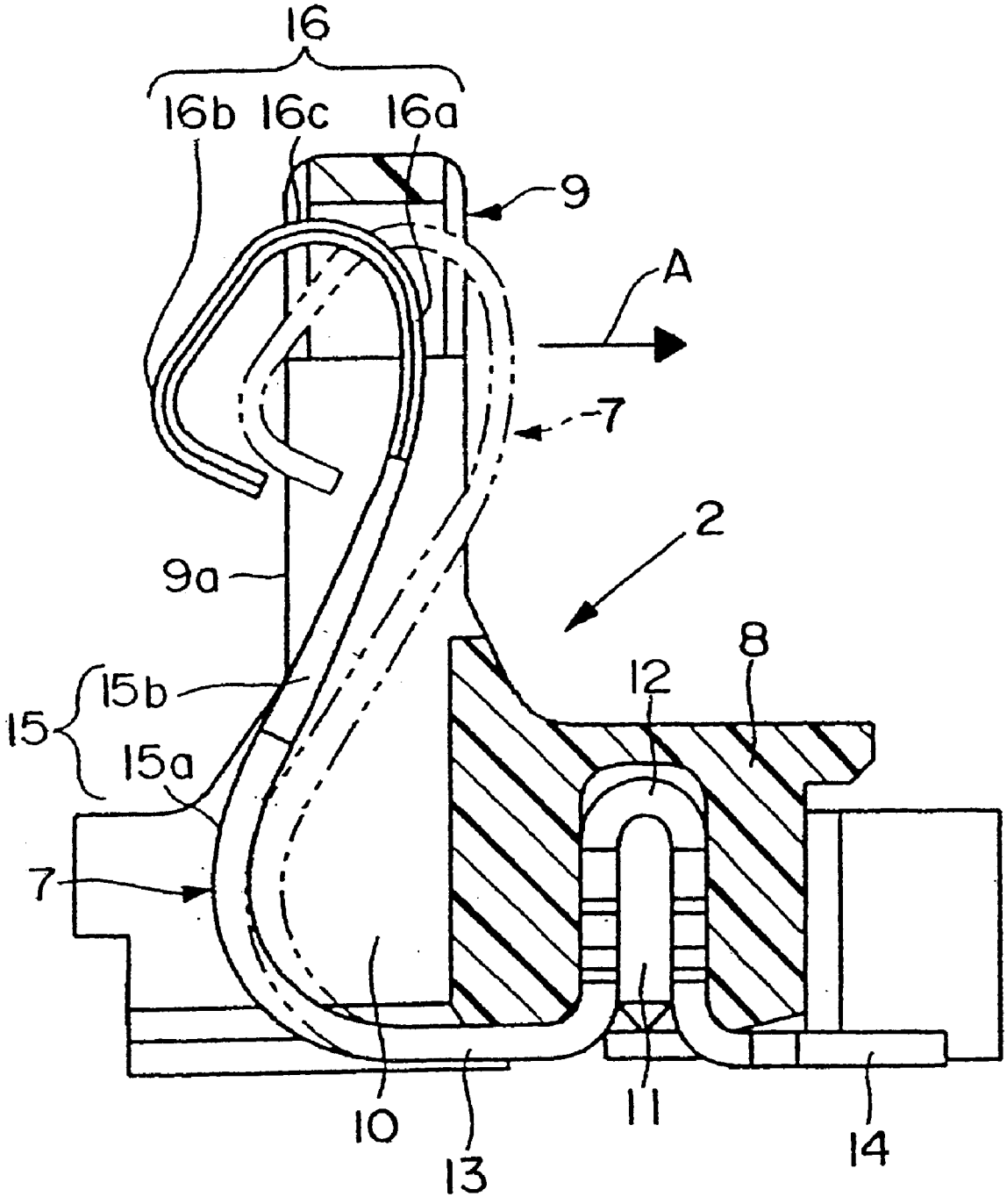
FIG. 5 is an enlarged vertical section through the plug connector, showing the unstressed condition of one of the terminals in full lines and the stressed or mating condition of the terminal in phantom.
Figure 6:
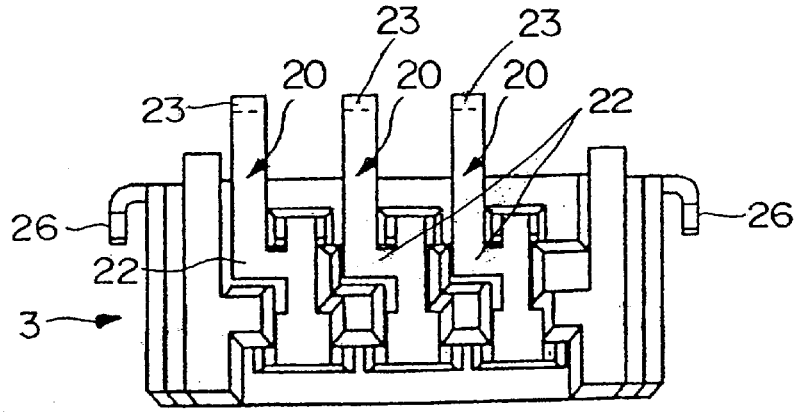
FIG. 6 is a top plan view of the receptacle connector.
Figure 7:
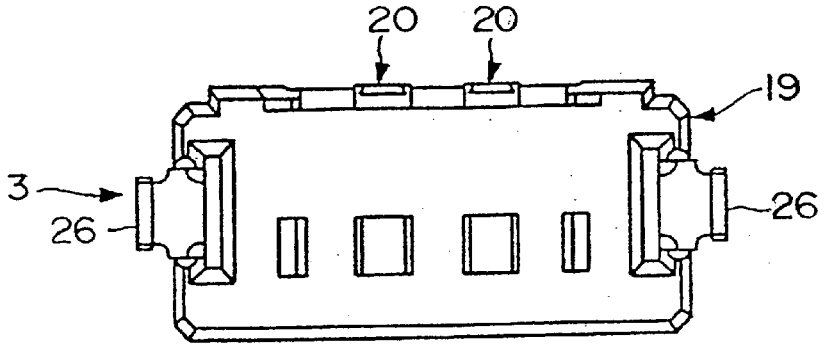
FIG. 7 is a front elevational view of the receptacle connector.
Figure 8:
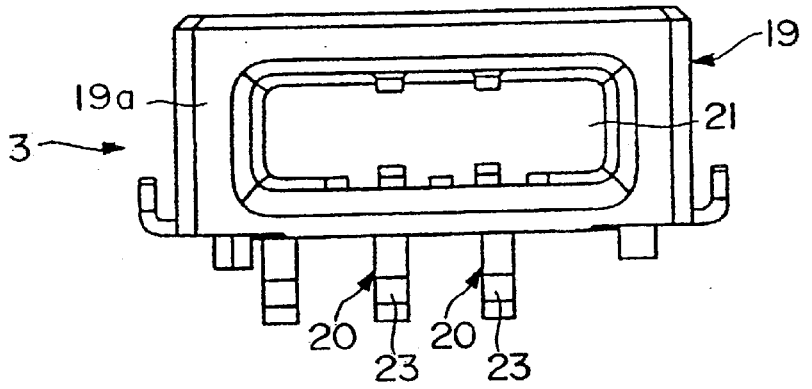
FIG. 8 is a bottom plan view of the receptacle connector.
Figure 9:
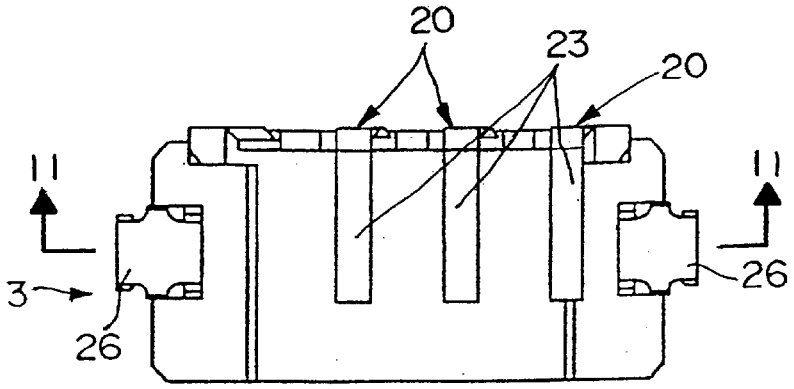
FIG. 9 is a rear elevational view of the receptacle connector.
Figure 10:
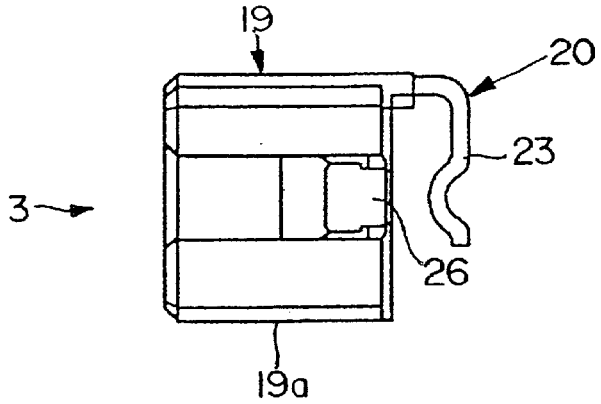
FIG. 10 is a side elevational view of the receptacle connector.
Figure 11:
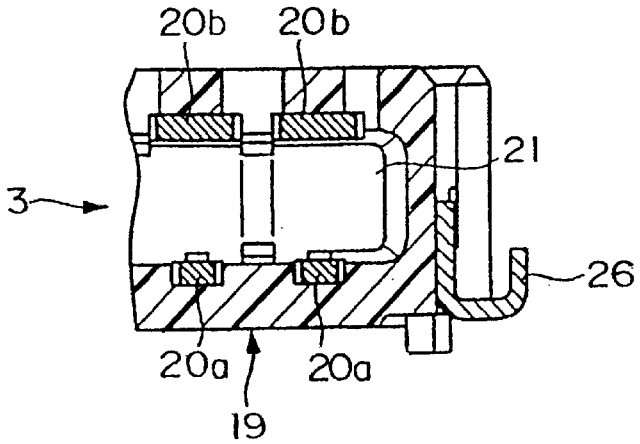
FIG. 11 is a fragmented section taken generally along line 11—11 of FIG. 9.
Figure 12:
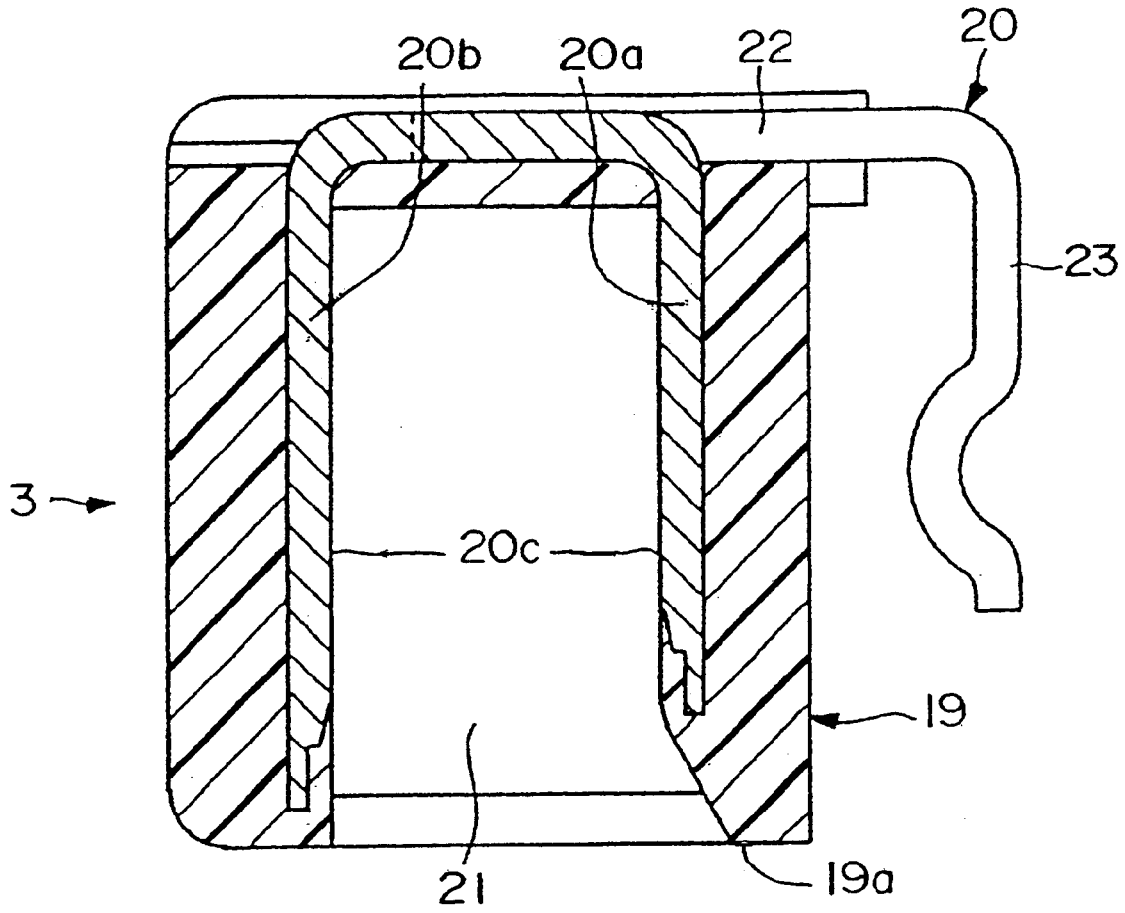
FIG. 12 is an enlarged vertical section through the receptacle connector similar to that of FIG. 1, with the plug connector removed.

FIG. 5 shows plug terminal 7 in full lines in an unstressed condition prior to mating of plug connector 2 with receptacle connector 3. When the connectors are mated, contact beam 16 is biased in the direction of arrow "A" whereupon the contact beam assumes the position shown in FIG. 1, with contact portions 16*a* and 16*b* of contact beam 16 projecting outwardly beyond side walls 9*a* of plug portion 9. Referring to FIGS. 6–12 in conjunction with FIG. 1, receptacle connector 3 includes a dielectric housing 19 which is a one-piece structure unitarily molded of plastic material or the like. The housing mounts three terminals, generally designated 20. The housing defines a receptacle portion 21 for receiving plug portion 9 of plug connector 2 in a mating direction which can be called the "Z" direction as seen in FIG. 1. In essence, housing 19 has a bottom surface 19*a* which defines an open end for receptacle portion 21.

Each terminal 20 of receptacle connector 3 includes a base portion 22 which is disposed on top of housing 19. An L-shaped solder tail 23 extends downwardly from one end of base portion 22 for solder connection to an appropriate circuit trace on circuit board 5. A pair of rigid contact portions 20*a* and 20*b* extend downwardly from base portion 22 into juxtaposition at opposite sides of receptacle portion 21. Contact portions 20*a* and 20*b* have inwardly facing contact surfaces 20*c* for engagement by contact portions 16*a* and 16*b* of a respective one of the plug terminals 7.

A pair of "fitting nails" 26 are mounted on housing 19 of receptacle connector 3. These fitting nails are fabricated of metal material and arc located at a rear side 19*c* of the housing for soldering to appropriate mounting pads on circuit board 5 when solder tails 23 of terminals 20 are soldered to the circuit traces on the board.

Figure 13:
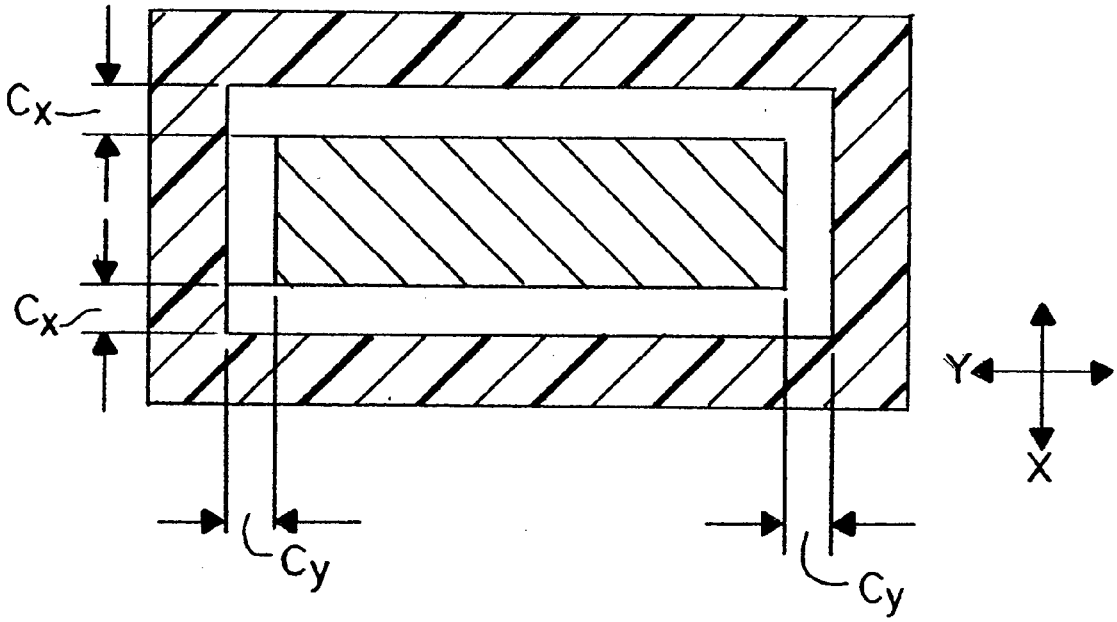
FIG. 13 is a schematic horizontal section through the plug portion of the plug connector and the receptacle portion of the receptacle connector when the connectors are mated to show the amount of floating movement between the connectors in the "X" and "Y" directions.

Referring to FIG. 13 in conjunction with FIG. 1, the invention contemplates that receptacle portion 21 of receptacle connector 3 being larger than plug portion 9 of plug connector 2 in "X" and "Y" directions which are transverse to the mating direction of the connectors. The clearances between the larger receptacle portion and the smaller plug portion in the "X" and "Y" directions are indicated by double-headed arrowed spaces "$C_x$" and "$C_y$" in FIG. 13. These dimensional clearances between the plug portion and the receptacle portion allow for floating movement between the connectors and, thereby, between circuit boards 4 and 5 in the "X" and "Y" directions generally transverse to the mating direction of the terminals.

Figure 14:
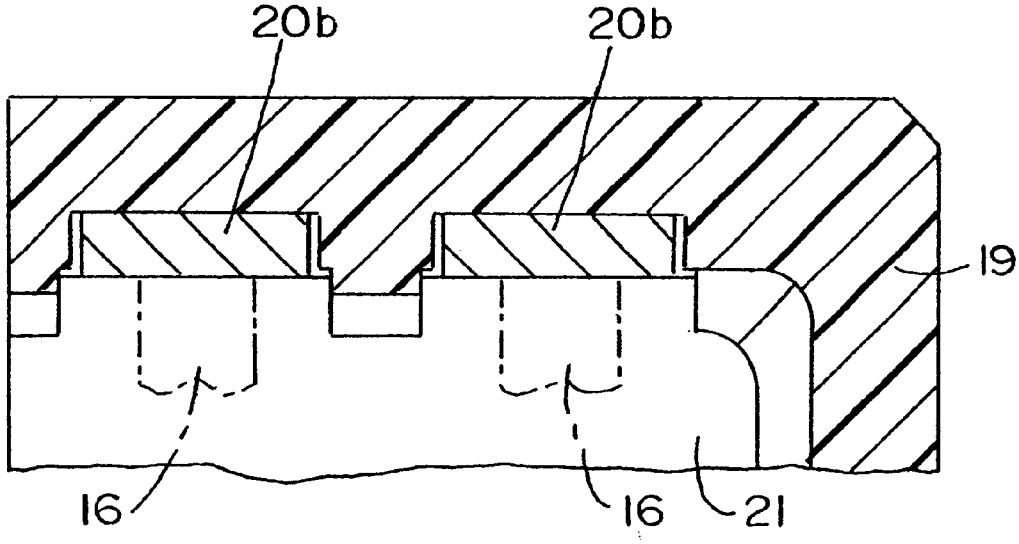
FIG. 14 is an enlarged fragmented horizontal section through a pair of the terminals of the receptacle connector in relation to a pair of the terminals of the plug connector shown in phantom.

FIG. 14 shows a pair of the contact portions 20*b* of receptacle terminals 20 in relation to a pair of contact beams 16 of plug terminals 7, the contact beams being shown in phantom. It can be seen that the widths of contact portions 20*b* of the receptacle terminals are significantly wider than the widths of the contact beams of the plug terminals. In comparing the differences between the widths of the contact portions with the dimensional clearances $C_y$ in FIG. 11, it can be understood that there will be constant engagement between contact portions 24*b* and contact beams 16 in the range of floating movement between the two connectors.

Referring to FIG. 1, arrow "A" represents the direction of deflection of contact beam 16 by spring beam 15 when the connectors are mated. Because of the angle of spring beam 15, a vertical force vector is created in the direction of arrow "B" from each contact beam 16 and contact portions 20*a* and 20*b* of receptacle terminals 20. When the connectors are mated, open end 19*a* of receptacle portion 21 of the receptacle connector will confront and abut against abutment wall 8*b* of plug connector 2. When all mating forces are removed from the receptacle connector, force vectors "B" from contact beams 16 and spring beams 15 of terminals 7 will cause the receptacle connector to back away from the plug connector a given distance as represented double-arrowed space $C_z$. This occurs automatically after the connectors are forced into mating condition causing abutment between open end 19*a* and abutment wall 8*b*, and automatically upon release of the mating forces. As a result, space $C_z$ provides for floating movement between the connectors and, thereby, circuit boards 4 and 5 in the mating direction of the connectors. Because of the resiliency of contact portions 16*a* and 16*b* of contact beam 16, these contact portions are resiliently biased against contact portions 20*a* and 20*b*, respectively, of receptacle terminals and, due to the flexing of spring beams 15, the contact portions of plug terminals 7 and the contact portions of receptacle terminals 20 will be in engagement at all times during the entire range of floating movement between the connectors transversely of the mating direction thereof.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A board-to-board electrical connector assembly, comprising:

a receptacle connector for mounting on a first circuit board and including a dielectric housing having a mating receptacle portion, and at least one conductive receptacle terminal mounted on the housing and having contact portions spaced apart generally at opposite sides of the receptacle portion; and a plug connector for mounting on a second circuit board and including a dielectric housing having a mating plug portion insertable into the receptacle portion of the receptacle connector in a mating direction with the plug portion being smaller than the receptacle portion in a direction transverse to said mating direction to provide a range of floating movement between the connectors and, thereby, between the circuit boards transversely of the mating direction, and at least one conductive plug terminal mounted on the housing and having oppositely facing resilient contact portions maintained in constant engagement with the spaced apart contact portions of the receptacle terminal throughout the entire range of said floating movement the resilient contact portions of the plug terminal being joined by a resilient curved portion to provide resiliency for the contact portions, and the resilient contact portions and the curved portion being at an end of a flexible cantilevered spring beam which extends generally in said mating direction.

2. The connector assembly of claim 1 wherein said resilient contact portions of the plug terminal, in an unstressed condition, are spaced apart wider than the spacing between the contact portions of the receptacle terminal.

3. The connector assembly of claim 1 wherein said resilient contact portions of the plug terminal, in an unstressed condition, arc spaced apart a sufficient distance to maintain constant engagement with the contact portions of the receptacle terminal throughout the entire range of said floating movement.

4. The connector assembly of claim 1 wherein said resilient contact portions of the plug terminal resiliently engage the contact portions of the receptacle terminal in an "X" direction transverse to said mating direction, and the contact portions of the respective terminals have widths in a "Y" direction transverse to said "X" direction and transverse to said mating direction to maintain constant engagement when the connectors float in said "Y" direction.

5. The connector assembly of claim 1 wherein said plug portion is smaller than said receptacle portion in all directions transverse to said mating direction to provide floating movement between the connectors in "X" and "Y" directions, and including an open end of said receptacle portion being spaced from an abutment wall of the housing of the plug connector when the connectors are in mated condition to provide floating movement between the connectors in a "Z" direction parallel to the mating direction.

6. The connector assembly of claim 5 wherein said plug terminal includes a cantilevered spring beam extending generally in said mating direction.

7. The connector assembly of claim 6 wherein said spring beam extends at an angle to said mating direction such that a force vector is created against the receptacle terminal opposite the mating direction to automatically cause the open end of said receptacle portion to be spaced from the abutment wall of the plug connector in said "Z" direction.

8. An electrical connector assembly, comprising:

a receptacle connector having a dielectric housing with a mating receptacle portion, and at least one conductive receptacle terminal mounted on the housing and having contact portions spaced apart generally at opposite sides of the receptacle portion; and a plug connector including a dielectric housing having a mating plug portion insertable into the receptacle portion of the receptacle connector in a mating direction with the plug portion being smaller than the receptacle portion in a direction transverse to said mating direction to provide a range of floating movement between the connectors, and at least one conductive plug terminal mounted on the housing and having oppositely facing resilient contact portions maintained in constant engagement with the spaced apart contact portions of the receptacle terminal throughout the entire range of said floating movement, the resilient contact portions of the plug terminal being joined by a resilient curved portion to provide resiliency for the contact portions, and the resilient contact portions and the curved portion being at an end of a flexible cantilevered beam which extends generally in said mating direction.

9. The connector assembly of claim 8 wherein said resilient contact portions of the plug terminal, in an unstressed condition, are spaced apart wider than the spacing between the contact portions of the receptacle terminal.

10. The connector assembly of claim 8 wherein said resilient contact portions of the plug terminal, in an unstressed condition, are spaced apart a sufficient distance to maintain constant engagement with the contact portions of the receptacle terminal throughout the entire range of said floating movement.

11. The connector assembly of claim 8 wherein said resilient contact portions of the plug terminal resiliently engage the contact portions of the receptacle terminal in an "X" direction transverse to said mating direction, and the contact portions of the respective terminals have widths in a "Y" direction transverse to said "X" direction and transverse to said mating direction to maintain constant engagement when the connectors float in said "Y" direction.

12. The connector assembly of claim 8 wherein said plug portion is smaller than said receptacle portion in all directions transverse to said mating direction to provide floating movement between the connectors in "X" and "Y" directions, and including an open end of said receptacle portion being spaced from an abutment wall of the housing of the plug connector when the connectors are in mated condition to provide floating movement between the connectors in a "Z" direction parallel to the mating direction.

13. The connector assembly of claim 12 wherein said plug terminal includes a cantilevered spring beam extending generally in said mating direction.

14. The connector assembly of claim 13 wherein said spring beam extends at an angle to said mating direction such that a force vector is created against the receptacle terminal opposite the mating direction to automatically cause the open end of said receptacle portion to be spaced from the abutment wall of the plug connector in said "Z" direction.

* * * * *